US005675359A

United States Patent [19]

Anderson

[11] Patent Number: 5,675,359

[45] Date of Patent: Oct. 7, 1997

[54] JOYSTICK CONTROLLER

[75] Inventor: Douglas E. Anderson, Waterbury, Conn.

[73] Assignee: Advanced Technology Systems, Inc., Waterbury, Conn.

[21] Appl. No.: 372,572

[22] Filed: Jan. 13, 1995

[51] Int. Cl.[6] ..... G09G 5/08

[52] U.S. Cl. ..... 345/161; 74/471; 200/6 R

[58] Field of Search ..... 345/161; 273/438, 273/148 B; 338/68; 74/471; 200/6 R

[56] References Cited

U.S. PATENT DOCUMENTS

| | | | |
|---|---|---|---|
| Re. 29,938 | 3/1979 | Knutson | 180/89.15 |
| 2,849,548 | 8/1958 | Young | 200/6 |
| 3,103,127 | 9/1963 | Hartop | 74/471 |
| 3,270,260 | 8/1966 | Mehr | 317/255 |
| 3,331,971 | 7/1967 | Moller | 310/10 |
| 3,454,920 | 7/1969 | Mehr | 338/5 |
| 3,722,367 | 3/1973 | Clark et al. | 91/367 |
| 3,757,895 | 9/1973 | Knutson | 182/46 |
| 3,768,369 | 10/1973 | Knutson | 91/378 |
| 3,776,099 | 12/1973 | Knutson | 91/358 A |
| 3,851,328 | 11/1974 | Sottile et al. | 345/161 X |
| 3,863,098 | 1/1975 | Mehr | 315/367 |
| 3,985,194 | 10/1976 | Knutson | 180/89 A |
| 4,042,902 | 8/1977 | Meyer et al. | 338/128 |
| 4,046,005 | 9/1977 | Goroski | 73/133 R |
| 4,101,863 | 7/1978 | Lewicki | 338/128 |
| 4,275,611 | 6/1981 | Asher | 74/471 X |
| 4,382,166 | 5/1983 | Kim | 200/6 |
| 4,459,578 | 7/1984 | Sava et al. | 338/128 |
| 4,479,038 | 10/1984 | Marhold et al. | 345/161 |
| 4,489,303 | 12/1984 | Martin | 338/128 |
| 4,590,339 | 5/1986 | Scott-Jackson et al. | 200/6 |
| 4,646,087 | 2/1987 | Schumann | 340/870.31 |
| 4,853,630 | 8/1989 | Houston | 324/208 |
| 4,856,785 | 8/1989 | Lantz et al. | 345/161 |
| 4,910,503 | 3/1990 | Brodsky | 345/161 |
| 4,945,357 | 7/1990 | Tal | 341/20 |
| 5,068,498 | 11/1991 | Engel | 345/161 X |
| 5,140,313 | 8/1992 | Wen | 345/161 |
| 5,225,831 | 7/1993 | Osborn | 341/20 |
| 5,286,024 | 2/1994 | Winblad | 345/161 X |
| 5,345,214 | 9/1994 | Tsui | 345/161 X |
| 5,436,640 | 7/1995 | Reeves | 345/161 |

*Primary Examiner*—Richard Hjerpe
*Assistant Examiner*—Amare Mengistu
*Attorney, Agent, or Firm*—Ware, Fressola, Van Der Sluys & Adolphson LLP

[57] ABSTRACT

A joystick controller for utilizing omnidirectional pivoting manual displacement by an operator to operate transducers for producing control signals comprises a mounting plate defining an opening therethrough and gimbal mounting means secured to the mounting plate for pivotally mounting a joystick shaft extending through the opening. The joystick shaft has an operator knob on one end, and a gauge plate on the other end, the gauge plate having a first straight edge and a second straight edge perpendicular thereto. First and second lever arms are pivotally mounted and biased against the first and second straight edges of the gauge plate, whereby displacement of the joystick knob causes displacement of the gauge plate and pivots the lever arms biased thereagainst. Follower rods extend from the lever arms to engage the gauge plate. First and second transducers are respectively operated by the pivoting lever arms. The transducers are either potentiometers, Hall effect sensing devices, LDVT transducers or LED-based transducers. A spring biased sliding centering collar returns the joystick shaft to its neutral position, absent operator input. The opening in the mounting plate limits inclination of the joystick shaft to maintain biased engagement of the gauge plate and lever arms.

29 Claims, 6 Drawing Sheets

JOYSTICK CONTROLLER

FIELD OF THE INVENTION

The invention herein relates to a joystick controller using omnidirectional pivoting manual displacement by an operator for producing control signals.

BACKGROUND OF THE INVENTION

Joystick controllers are used to translate operator manipulations to electrical control signals. At least a direction and often velocity of motion are controlled. Typical applications are found in industrial equipment and construction equipment, such as forklift trucks and excavating equipment, where a joystick can provide one-hand operation of direction and speed in order to free the operator's other hand for controlling other aspects of the machine. Other typical applications for joysticks are in booms, trenching equipment, jetways, and the like.

It is important that joysticks used in such industrial, construction and transportation devices be dependable and accurate in their response to operator inputs. In this regard, it is desirable that a joystick include rugged mechanical structure for receiving the operator manipulation, and means for translating the operator input into control signals which are accurate and cannot be abused or damaged by such operator inputs.

SUMMARY OF INVENTION

It is a principal object of the invention herein to provide a joystick controller for converting omnidirectional pivoting manual displacement by an operator to electrical control signals indicative of that manual displacement.

It is another object of the invention herein to provide a joystick controller of the above character which is rugged, dependable and accurate, with a minimum of moving parts.

It is a further object of the invention herein to provide a joystick controller which is characterized by a biased, resilient interface between a manually displaceable joystick and transducer means for translating the displacement of the joystick to control signals.

In accordance with the object of the invention herein, there is provided a joystick controller for omnidirectional pivoting manual displacement by an operator to produce electrical control signals, comprising a mounting plate and a joystick shaft extending through the mounting plate and gimbal mounted to the mounting plate intermediate its length. The joystick shaft has an operator's knob on one end thereof, and a gauge plate is mounted to the other end of the joystick shaft. The gauge plate has a first straight edge, and a second straight end perpendicular to the first straight edge. A first transducer and pivoting lever arm actuator is mounted to the mounting plate, with the lever arm biased against the first straight edge of the gauge plate. A second transducer and pivoting lever arm actuator are also supported on the mounting plate, with the second lever arm biased against the second straight edge of the gauge plate. Pivotal manual displacement of the joystick on its gimbal mounting causes corresponding displacement of the gauge plate and the lever arms biased to follow the gauge plate, positioning the transducers to provide a signal indicative of the direction of joystick displacement. The invention further contemplates utilizing the same transducers to provide an indication of the extent of manual displacement.

According to further aspects of the invention, each of the lever arms has an upstanding follower biased against a respective straight edge of the gauge plate, and the lever arms are pivotally mounted to a subplate supported below the mounting plate with the gauge plate being positioned therebetween. Coil springs bias the followers against the gauge plate.

According to additional aspects of the invention, the transducers are potentiometers, and the lever arms are mounted to input shafts of the potentiometers for rotating them in response to displacement of the gauge plate. Alternately, the transducers are Hall effect sensors or switches, with a magnetic input being positioned on each of the lever arms. Also alternately, the transducers are LED devices with the lever arms mounting light baffles, or LVDT (Linear Velocity Differential Transducer) devices with the lever arms driving moveable coil slugs.

According to other aspects of the invention, the joystick controller includes means for centering the joystick shaft in the absence of operator input. One centering means comprises a collar slidingly received on the joystick shaft and having an annular contact surface biased against a flat surface associated with the mounting plate. An additional, backup centering means comprises a spring secured to the gauge plate end of the joystick in alignment with the joystick's neutral position.

The invention further includes positioning the edge of the opening in the mounting plate, through which the joystick shaft extends, to limit angular displacement of the joystick shaft and maintain biased engagement of the gauge plate and lever arms.

Other and more specific objects and features of the invention herein will in part be recognized by those skilled in the art and will in part appear in the following description of the preferred embodiments and claims, taken together with the accompanying drawings.

DRAWINGS

The same reference numerals refer to the same elements throughout the various figures.

DESCRIPTION OF PREFERRED EMBODIMENTS

Figure 1:
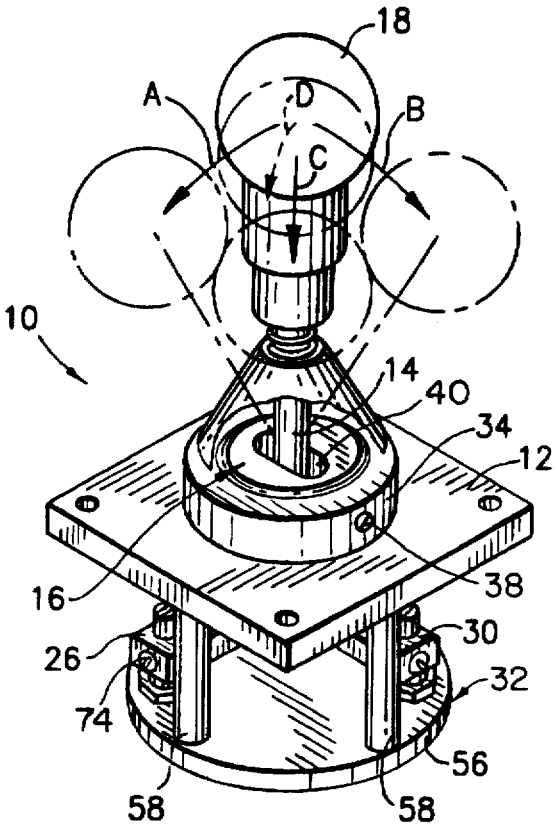
FIG. 1 is a perspective view of a joystick controller according to the invention herein.

FIGS. 1–10 depict a first joystick controller 10 according to the invention herein. The joystick controller 10 generally comprises a mounting plate 12 having a joystick shaft mounted therethrough on a gimbal mount 16. The joystick shaft has a knob 18 at one end thereof, and a gauge plate 20 at the other end thereof. A spring biased center collar 22 maintains the joystick in neutral position. A first transducer is a potentiometer 24 operated by a lever arm actuator 26 and a second transducer is a potentiometer 28 operated by a lever arm actuator 30, in response to manual displacement of the joystick. The potentiometers are mounted on a subframe 32.

The joystick shaft may be manipulated in omnidirectional pivoting displacement, as illustrated by the arrows A–D and dotted positions in FIG. 1. The term "omnidirectional" as used herein means that the joystick can be displaced in 360° of freedom with respect to the top surface of the mounting plate 12, although the extent of the tilting of the joystick 14 is limited, as described more fully below.

The gimbal mount 16 comprises an outer ring 34 integral with the mounting plate 12. As best seen in FI 5, 7 and 9, a truncated sphere 36 is mounted within the annular collar 34 on pins 38 defining a first pivot axis. The truncated sphere defines a slot opening 40 through which the joystick shaft 14 extends. The joystick shaft is pivotally mounted to the truncated sphere by a pin 42, which lies in the same plane as pins 38, thereby providing the two-axis gimbal mounting of the joystick shaft 14.

The knob 18 is threaded onto the upper end of the joystick shaft 14. The knob 18 bears against a spring retainer 44 which captures a coil spring 46 biasing the centering collar 22 against the flat, annular top centering surface 35 of the outer ring 34 of the gimbal mount. The centering collar 22 is provided in the shape of a truncated cone and has an annular lower surface 48, best seen in FIGS. 5 and 7, which bears evenly against the centering surface 35 of the annular ring 34 when the joystick is in its neutral position. Upon displacement of the joystick shaft 14, the centering collar 22 slides upwardly toward knob 18, compressing the spring 46, and causing point contact between the lower annular surface 48 of the centering collar and the centering surface 35 of the outer ring 34. If the joystick shaft is released, the spring 46 drives the centering collar into flush engagement with the centering surface 35, thereby centering the joystick shaft as shown in FIGS. 1 and 2.

Figure 5:
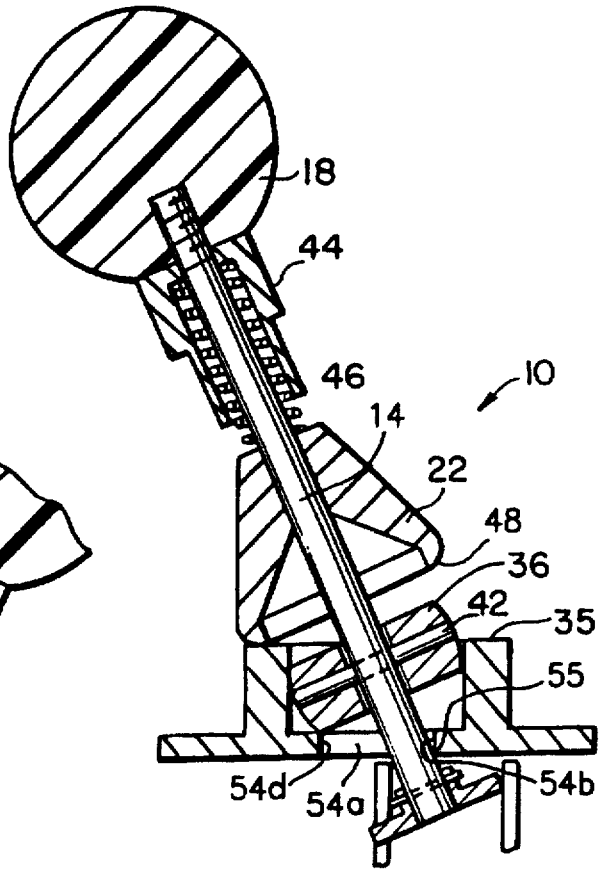
FIG. 5 is a longitudinal sectional view of the joystick controller of FIG. 1, taken along the lines 5—5 of FIG. 4 and showing joystick shaft displacement corresponding to FIG. 4.

The gauge plate 20 is mounted to the other end of the joystick shaft 14, below the mounting plate 12. As best seen in FIGS. 3, 4, 6, 8 and 10, the gauge plate 20 is generally rectangular, and comprises at least a first straight edge 50 and a second straight edge 52 which is perpendicular to the first straight edge 50. As best seen in FIGS. 5, 7 and 9, the portion of the joystick shaft 14 between the gauge plate 20 and the pivot pin 42 extends through an opening 54 in the mounting plate 12.

The opening 54 is square and has its parallel sides **54*a*, 54*c* and 54*b*, 54*d* respectively aligned with the gimbal pivot axes established by pins 38, 42, and with the first and second straight edges of the gauge plate. For instance, in FIG. 9 sides 54*c* are parallel with pin 42, and sides 54*b*, 54*d* are parallel with pins 38. The opening 54 is sized to limit the degree of angular displacement the joystick 14 may exhibit relative to the mounting plate 12 by contact, e.g., at 55. When the joystick controller 10 is oriented with respect to the operator to present the pivot axes as an X–Y coordinate system, the square opening provides for a maximum displacement in one of the X or Y axis, limited by one edge of the square opening, with movement of the joystick shaft in the other of the X or Y axis obtainable by sliding the joystick shaft along the edge of the square opening. This also provides that, as the gauge plate 20 moves in an arc below the mounting plate 12, the gauge plate is spaced from the mounting plate, even in the greatest degree of inclination of the joystick shaft 14, and that the gauge plate does not disengage from the lever arm actuators 26 and 30**.

Figure 2:
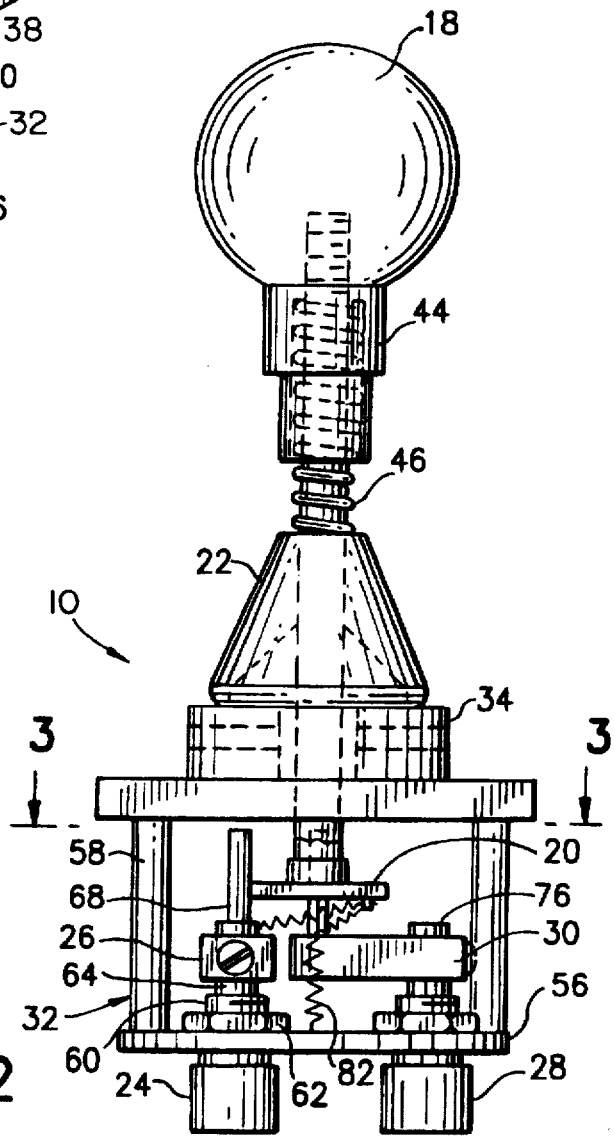
FIG. 2 is a side elevation view of the joystick controller of FIG. 1.
Figure 3:
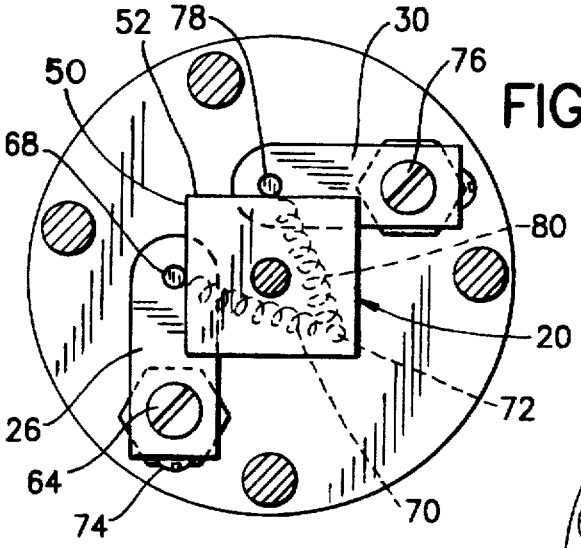
FIG. 3 is a sectional view, taken along the lines 3—3 of FIG. 2 of the joystick controller of FIG. 1 in its neutral position.
Figure 4:
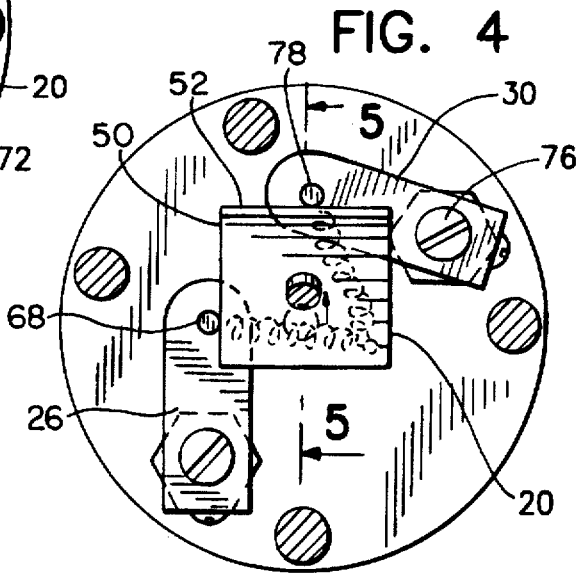
FIG. 4 is a sectional view of the joystick controller of FIG. 1, similar to FIG. 3 but with the joystick shaft displaced from its neutral position.

The subframe 32, as best seen in FIGS. 1 and 2, comprises a subplate 56 suspended below and parallel to the mounting plate 12 on struts 58. The first potentiometer 24 is mounted through the subplate 56 by means of its threaded mounting shaft 60 and nut 62, with its rotatable operating shaft 64 protruding upwardly. The first lever arm 26 has one of, its ends mounted on the shaft 64. A follower 68 extends upwardly from the other end of the lever arm 26, and is engaged against the straight edge 50 of the gauge plate 20. Coil spring 70 has one end secured to the follower 68 and its other end secured to an anchor pin 72 on gauge plate 20, and serves to bias the follower 68 against the straight edge 50. The lever arm extends generally parallel to the first edge 50 of the gauge plate 20 when the joystick is in its neutral position, as best seen in FIGS. 1, 2 and 3. The lever arm 26 is secured to the shaft 64 potentiometer 24 by means of a set screw 74, which permits the shaft of the potentiometer to be adjusted to a neutral output with the joystick in its neutral position.

The second potentiometer 28 is also mounted through the subplate 56, and lever arm 30 is mounted to the operating shaft 76 of the potentiometer 28. A follower 78 extends upwardly from the lever arm 30 and bears against the straight edge 52 of the gauge plate 20. Coil spring 80 biases the follower 78 against straight edge 52. The lever arm 30 lies generally along the straight edge 52 of gauge plate 20 when the joystick is in the neutral position shown in FIG. 3.

The joystick controller 10 also includes a centering spring 82 extending from the end of the joystick shaft 14 and gauge plate 20 to the subplate 56, providing an additional backup centering force for returning the joystick shaft to its neutral position absent operator input. In most applications, it is desirable that the joystick return to its neutral position absent operator input, which generally idles any equipment being controlled by the joystick.

FIGS. 3–10 illustrate operation of the joystick controller 10. As noted above, FIG. 3 (as well as FIGS. 1 and 2) illustrate the joystick shaft 14 in its neutral position. In the neutral position, the lever arms 26, 30 lie generally parallel to edges 50, 51 respectively, of the gauge plate 20, and the potentiometers are positioned for neutral output. With respect to FIGS. 4 and 5, an operator input has displaced the joystick shaft in the direction of arrow A in FIG. 1, with a corresponding directional displacement of the gauge plate 20. This is a single axis displacement of the gauge plate 20, which results in pivoting the lever arm 30 and rotating the shaft 76 of the potentiometer 28. As is well-known, rotating a potentiometer connected in an electrical circuit will provide a change in a signal provided by the circuit, and can be utilized as a control signal. During the displacement of FIGS. 4 and 5, the follower 68 slides along the edge 50 of gauge plate 20, without pivoting lever arm 26.

Figure 6:
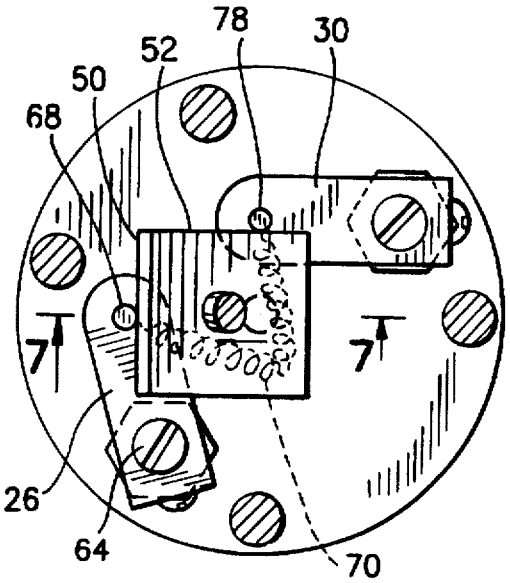
FIG. 6 is a sectional view of the joystick controller of FIG. 1, similar to FIG. 3 but with the joystick shaft displaced from its neutral position.
Figure 7:
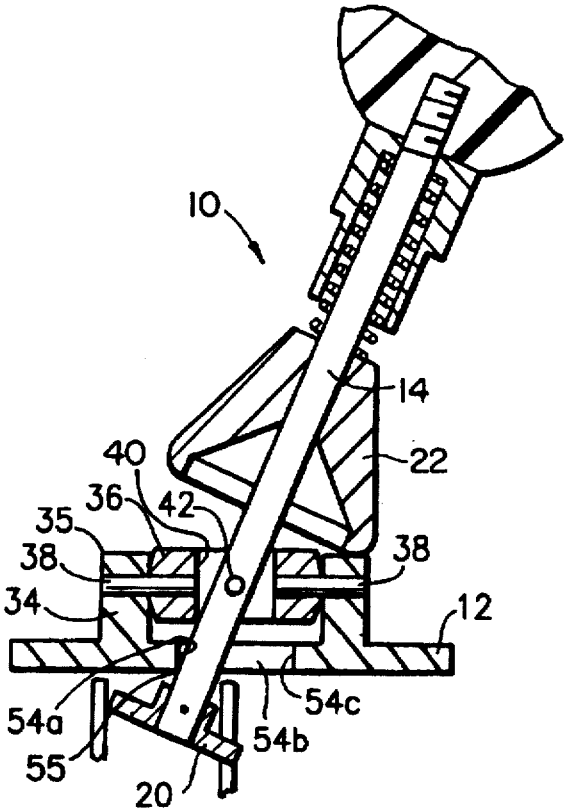
FIG. 7 is a longitudinal sectional view of the joystick controller of FIG. 1, taken along the lines 7—7 of FIG. 6 and showing joystick shaft displacement corresponding to FIG. 6.

With reference to FIGS. 6 and 7, the displacement of the joystick shaft 14 indicated by the arrow B in FIG. 1 is illustrated. This displacement is perpendicular to the displacement illustrated in FIGS. 4 and 6 described above, and results in the lever arm 28 rotating shaft 64 of the potentiometer 24. The displacement of the gauge plate 20 is transmitted to the lever arm by follower 68, and follower 76 slides along edge 52 without pivoting lever arm 30.

Figure 8:
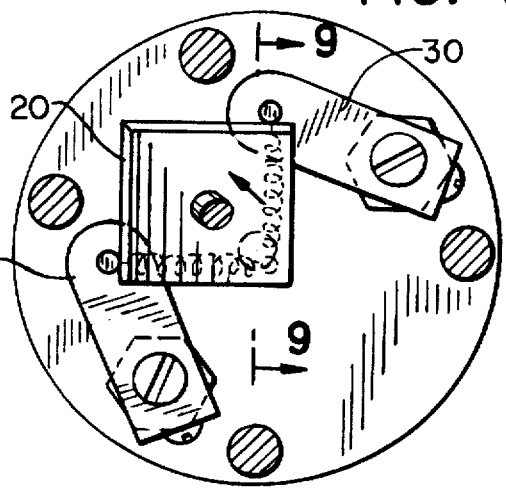
FIG. 8 is a sectional view of the joystick controller of FIG. 1, similar to FIG. 3 but with the joystick shaft displaced from its neutral position.
Figure 9:
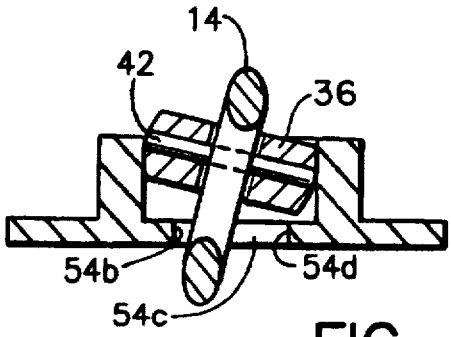
FIG. 9 is a fragmentary longitudinal sectional view of the joystick controller of FIG. 1, taken along the lines 9—9 of FIG. 8 and showing the gimbal mount of joystick shaft displacement corresponding to FIG. 8.

FIGS. 8 and 9 illustrate displacement of the joystick shaft 14 in the direction of arrow C of FIG. 1, i.e., in a direction which causes rotation of both lever arms 26 and 30, thereby rotating the shafts of both potentiometers to provide a control signal corresponding to the operator manipulation of the joystick. Both followers 68, 76 slide along the edges 50, 52, in addition to being displaced and thereby causing pivoting movement of the lever arms.

Figure 10:
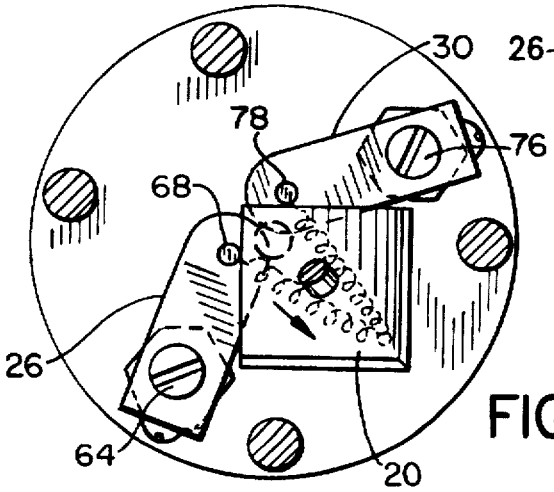
FIG. 10 is a sectional view of the joystick controller of FIG. 1, similar to FIG. 3, but with the joystick shaft displaced from its neutral position.

With reference to FIG. 10, it illustrates displacement of the joystick indicated by the dotted arrow D in FIG. 1, with corresponding displacement of the gauge plate 20. Both of the lever arms 26 and 30 are rotated in the opposite directions from FIGS. 8 and 9 described above, thereby rotating the shafts of the potentiometers to adjust an electrical control signal according to a different operator input. It will be appreciated that in all instances, the amount of inclination of the joystick shaft produces a proportional rotation of the potentiometer shafts, and thereby signals which are indicative of both direction and extent of operator input. Thus the signals can be used, for instance, to control both the direction and speed of a vehicle.

In all of the manipulations of the joystick, the followers 68 and 78 of lever arms 26 and 30, respectively, are biased against the straight edges 50 and 52 of the gauge plate, again respectively, by the coil springs 70 and 80. However, it should additionally be noted that the gauge plate 20 swings through an arc when manipulated, as best seen in FIGS. 5 and 7, wherein the edges 50, 52 of the gauge plate ride up and down the followers 68 and 78, while the followers are maintained against the edge plate. This accommodation of the arcuate motion of the gauge plate through a biased sliding interface contributes to the simplicity of structure and reliability of the joystick controller 10, and permits use of a variety of transducers operated independently of the arcuate motion of the gauge plate.

Figure 11:
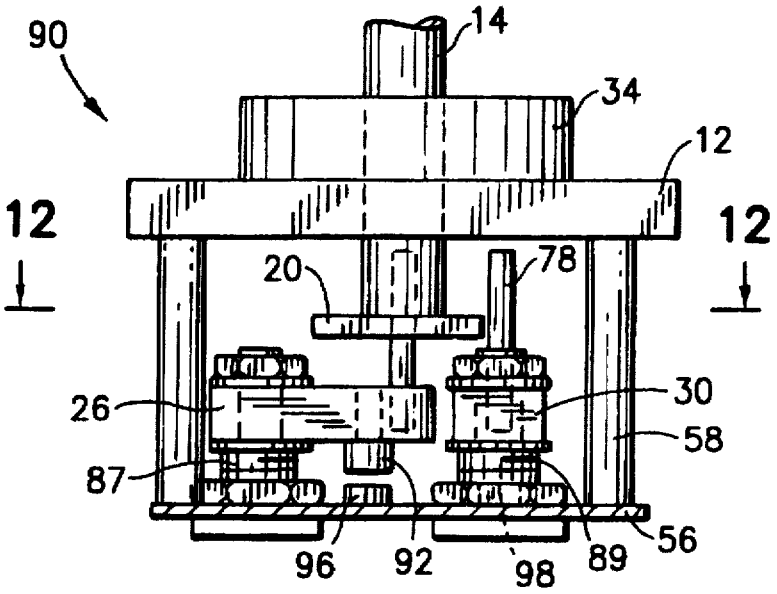
FIG. 11 is a side elevation view, partially broken away, of another joystick controller according to the invention herein.
Figure 12:
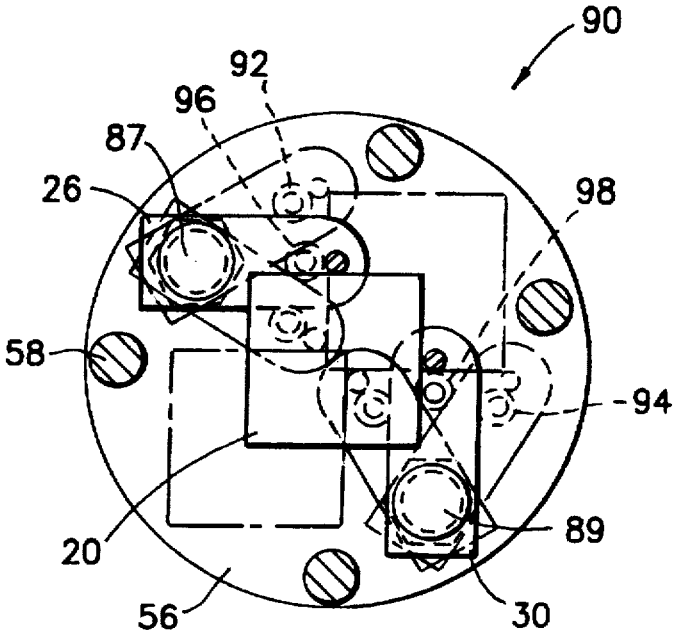
FIG. 12 is a sectional view of the joystick controller of FIG. 11, taken along the lines 12—12 of FIG. 11.

With reference to FIGS. 11 and 12, another joystick controller 90 according to the invention herein is illustrated. It is the same as the joystick controller 10 in its provision of a gimbal mounted joystick shaft 14 extending through a mounting plate 12 and including a gauge plate 20 on the distal end thereof. Similarly, lever arms 26 and 30 are pivotally mounted to a subplate 56 depending on struts 58 below the mounting plate 12, except that lever arms 26 and 30 are mounted on shafts 87, 89 respectively instead of on the input shafts to potentiometers. The centering collar 22 is not shown, for simplicity in the drawing.

The joystick controller 90 differs from the joystick controller 10 described above in the type of transducer utilized to convert motion of the gauge plate and lever arms into electrical control signals. The joystick controller 90 utilizes magnets 92 and 94 respectively mounted near the free ends of the lever arms 26 and 30, and Hall effect devices 96 and 98 mounted to the subplate 56 for cooperation with the Hall effect magnets. It will be appreciated that electrical control signal may be produced from the motion of the magnets over the Hall effect devices as the joystick shaft is manipulated to move the lever arms 26, 30, and that the lever arms 26, 30 provide a constant vertical spacing of the magnets 92, 94 with respect to the Hall effect sensing devices 96, 98, despite the arcuate motion of the gauge plate 20, permitting the Hall effect sensing devices to operate accurately in the intended manner. The Hall effect devices 96, 98 may be proportional sensors or switches, as desired. Microswitch Division of Honeywell Corporation provides a line of Hall effect transducers suitable for this joystick. It should also be noted that the subplate 56 in the joystick controller 90 is a printed circuit board, which may mount other elements of an electrical control circuit together with the Hall effect devices.

Figure 13:
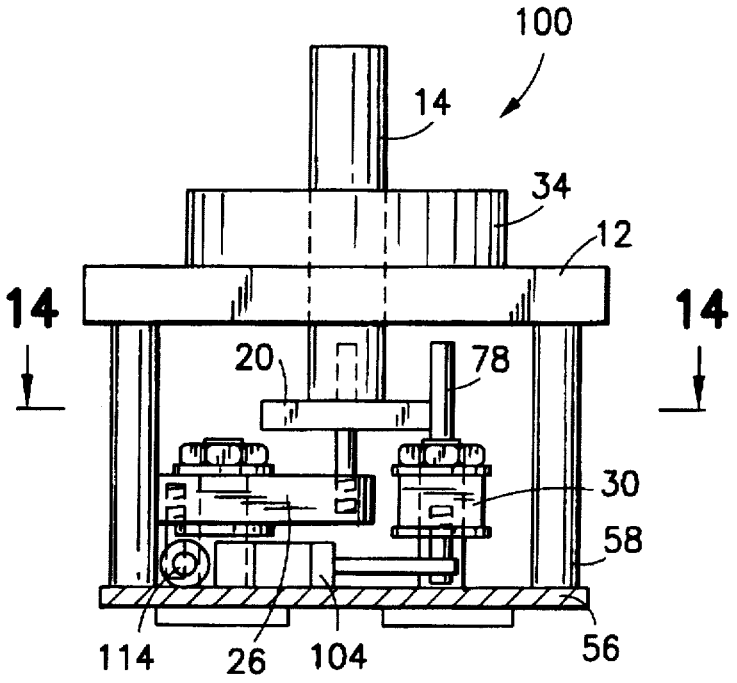
FIG. 13 is a side elevation view, partially broken away, of another joystick controller according to the invention herein.
Figure 14:
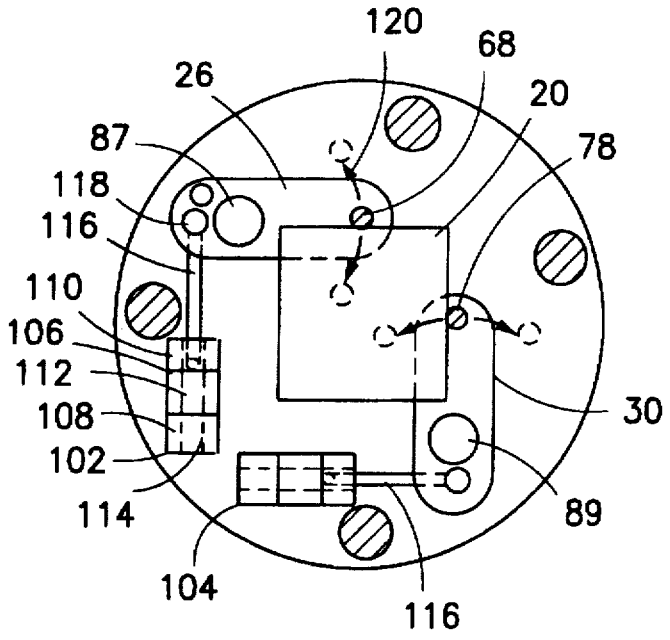
FIG. 14 is a sectional view of the joystick controller of FIG. 13, taken along the lines 14—14 of FIG. 13.

FIGS. 13 and 14 illustrate another joystick controller 100 according to the invention herein, characterized by the use of LVDT (Linear Velocity Differential Transducer) transducers 102 and 104. The joystick controller comprises the mounting plate 12, gimbal mounted joystick shaft 14, gauge plate 20, and lever arms 26 and 30 having followers 68 and 78, respectively, as described above, and centering collar, not shown. The lever arms 26, 30 are pivotally mounted on subplate 56 on pivot shafts 87, 89, and are pivotally displaced by operator input to the joystick shaft 14.

The LVDT transducer 102 comprises a central primary coil 106 and two flanking secondary coils 108 and 110. An iron core slug 112 is slidably disposed in passage 114 formed by the aligned open centers of the coils. Connecting rod 116 has one end attached to the core slug 112 and its other end attached to the pivot arm 26 at 118 spaced from the pivot shaft 87. Thus, as the pivot arm 26 is pivoted through the range of motion indicated by arrow 118 in FIG. 14, the coil slug 112 is correspondingly displaced in the passage 114.

The central coil 106 is connected in an AC circuit and the secondary coils 108, 112 are tapped. The signal derived from the secondary coils is dependent upon the position of the coil slug 112, providing a position dependent output. LVDT transducer 104 is connected to lever arm 30 by connecting rod 122, and provides a signal for displacement in the other axis from LVDT 102, and the transducers thereby together indicate the direction and extent of motion of operator input to joystick 14.

Figure 15:
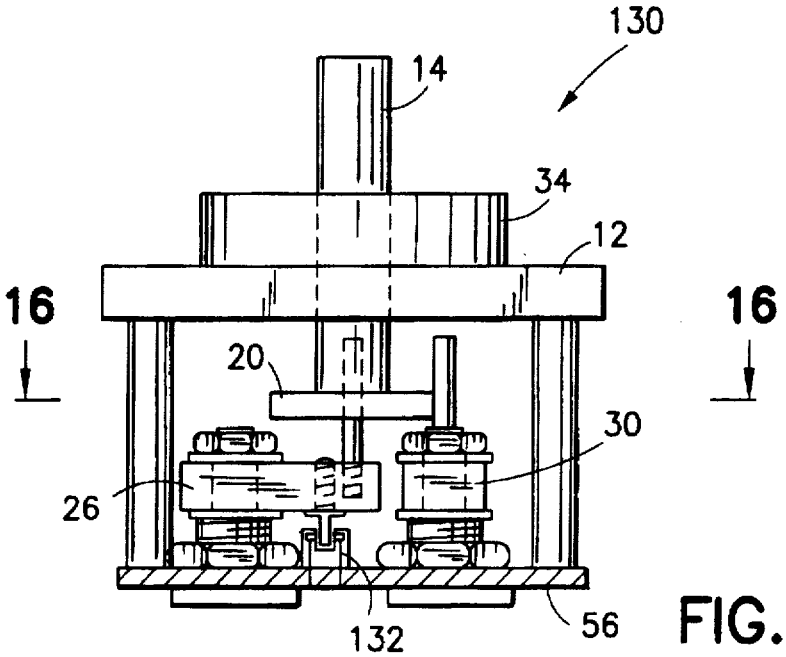
FIG. 15 is a side elevation view, partially broken away, of another joystick controller according to the invention herein.
Figure 16:
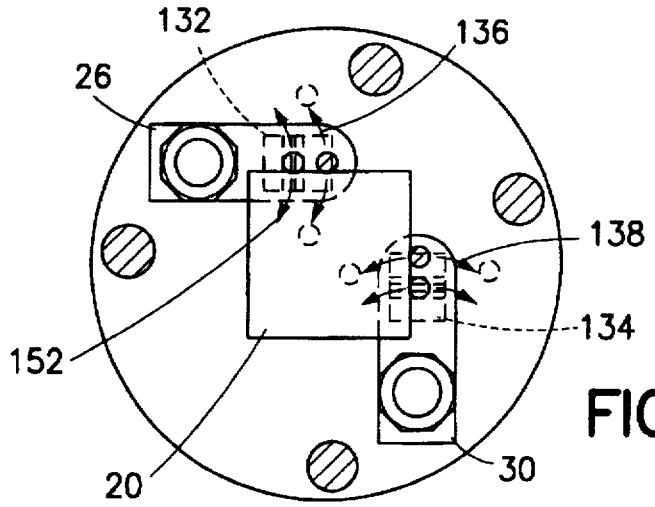
FIG. 16 is a sectional view of the joystick controller of FIG. 15, taken along the lines 16—16 of FIG. 15.
Figure 17:
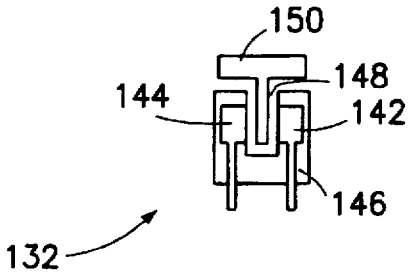
FIG. 17 is a fragmentary side elevation view of a transducer of the joystick controller of FIG. 15.

With reference to FIGS. 15–17, another joystick controller 130 is shown, using light emitting diode (LED)—based transducers 132 and 134. The joystick controller 130 is like the joystick controllers 10, 90 and 100 described above, except for the use of the LED-based transducers in place of the transducers used in the other units. Thus, a plate 12 carries gimbal-mounted joystick shaft 14, which displaces gauge plate 20 in response to operator input. Lever arms 26, 30 are biased against the gauge plate 20, and are pivoted through the range of motion indicated by arrows 136, 138, respectively, by displacement of gauge plate 20.

The LED-based transducer 132 is shown in FIG. 17. It comprises an LED emitter 142 and a facing LED detector 144 in a frame 146 which provides a separation in gap 148. The foregoing parts of the LED-based transducer 134 are mounted to the subplate 56 below lever arm 26, and the transducer further comprises a vane 150 mounted to lever arm 26 for movement in gap 148. As lever arm 26 is pivoted in response to operator input, vane 150 is moved in gap 148, as indicated by arrow 152 in FIG. 16, to unblock the LED emitter 142 and permit light to reach collector 144, in proportion to the extent of movement. The LED collector is of the "split" type, so that the output is indicative of both the direction and extent of movement. The LED-based transducer 134 is similarly cooperative with lever arm 30, and the LED-based transducers 132 and 134 together provide a signal indicative of the direction and extent of operator input to the joystick shaft 14.

The LED-based transducers 132, 134 can also be operated as switches, i.e., to provide an output at a distinct level of light reception. This provides an indication of direction of displacement of the joystick shaft, but not a linear indication of extent of displacement.

Accordingly, described above are preferred embodiments of joystick controllers which admirably achieve the objects of the invention herein. It will be appreciated that changes may be made from the preferred embodiments without departing from the spirit and scope of the invention, which is limited only by the following claims.

I claim:

1. A joystick controller for converting omnidirectional pivoting manual displacement by an operator to control signals, the joystick comprising:

A) a mounting plate defining an opening therethrough;

B) a joystick shaft having an operator's knob on one end thereof;

C) gimbal mounting means pivotally connecting the joystick shaft intermediate its length to the mounting plate and extending through the opening defined by the mounting plate, for omnidirectional manual displacement with respect to the mounting plate;

D) a gauge plate mounted to the other end of the joystick shaft, the gauge plate having a first straight edge and a second straight edge perpendicular to the first straight edge; and E) a first transducer and a first pivoting lever arm actuator supported on the mounting plate and operating the first transducer by pivoting motion of the first lever arm actuator, the first lever arm actuator biased against the first straight edge of the gauge plate, and a second transducer and a second pivoting lever arm actuator supported on the mounting plate and operating the second transducer by pivoting motion of the second lever arm actuator, the second lever arm actuator biased against the second straight edge of the gauge plate;

wherein pivoting manual displacement of the joystick on its gimbal mounting causes corresponding displacement of the gauge plate and pivots the lever arm actuators biased thereagainst, and the first and second lever arm actuators respectively position the first and second transducers for providing control signals indicative of the manual displacement.

2. A joystick controller as defined in claim 1 wherein the pivoting lever arm actuators each include a follower upstanding therefrom, and the followers are respectively biased against the first and second straight edges of the gauge plate to follow displacement thereof.

3. A joystick controller as defined in claim 2 wherein the first and second lever arm actuators are biased against the gauge plate by coil springs, one end of a first coil spring extending between the gauge plate and the first lever arm actuator, and a second coil spring extending between the gauge plate and the second lever arm actuator.

4. A joystick controller as defined in claim 3 wherein the coil springs extend from the followers of the lever arms.

5. A joystick controller as defined in claim 3 wherein the lever arm actuators are pivotally mounted to a subplate secured to and positioned spaced apart from the mounting plate, with the gauge plate and its displacement motion accommodated therebetween.

6. A joystick controller as defined in claim 5 wherein the first and second transducers are potentiometers mounted to the subplate, and the first and second lever arm actuators are respectively mounted to the shafts of the potentiometers for rotating the shafts in response to manual displacement of the joystick shaft.

7. A joystick controller as defined in claim 5 wherein the first and second transducers are Hall effect devices mounted on the subplate, and the lever arm actuators are pivotally mounted to the subplate and have magnets mounted thereto for relative movement with respect to the Hall effect devices in response to manipulation of the joystick shaft.

8. A joystick controller as defined in claim 7 wherein the Hall effect devices are Hall sensors.

9. A joystick controller as defined in claim 7 wherein the Hall effect devices are Hall switches.

10. A joystick controller as defined in claim 5 wherein the first and second transducers are LVDT transducers each including a core slug slidably disposed in a multiple coil array and displaced therein by its respective lever arm actuator.

11. A joystick controller as defined in claim 5 wherein the first and second transducers are LED-based transducers including a light source and a light detector mounted to the subplate, and a vane mounted to the associated lever arm actuator controlling the transmission of light therebetween.

12. A joystick controller as defined in claim 1 wherein the first and second transducers are potentiometers, and the first and second lever arm actuators are respectively mounted to the shafts of the potentiometers for rotating the shafts in response to manual displacement of the joystick shaft.

13. A joystick controller as defined in claim 1 wherein the first and second transducers are Hall effect devices, and the lever arm actuators have magnets mounted thereto for relative movement with respect to the Hall effect devices in response to manipulation of the joystick shaft.

14. A joystick controller as defined in claim 1 wherein the first and second transducers are LVDT transducers each including a core slug slidably disposed in a multiple coil array and displaced therein by its respective lever arm actuator.

15. A joystick controller as defined in claim 1 wherein the first and second transducers are LED-based transducers including a light source and a light detector fixedly mounted with respect to the mounting plate, and a vane mounted to the associated lever arm actuator controlling the transmission of light therebetween.

16. A joystick controller as defined in claim 1 wherein the mounting plate has a flat centering surface associated therewith surrounding the opening through which the joystick shaft extends, and further comprising F) centering means including a centering collar slidably received on the joystick shaft between the operator's knob and the centering surface, the centering collar having an annular surface which seats on the centering surface to center the joystick in a neutral position, and spring means biasing the centering collar against the centering surface.

17. A joystick controller as defined in claim 16 wherein the centering surface is defined by an outer ring of gimbal mounting means, the outer ring being mounted to the mounting plate surrounding the opening defined therethrough.

18. A joystick controller as defined in claim 12 and further comprising:

G) secondary centering means including a coil spring connected to the gauge plate and tensioned to hold the gauge plate and joystick shaft in a neutral position, absent operator input.

19. A joystick controller as defined in claim 1 wherein the opening defined by the mounting plate and having the joystick shaft extending therethrough is sized and shaped to limit inclination of the joystick shaft and corresponding displacement of the gauge plate to maintain the lever arms in biased engagement with the gauge plate.

20. A joystick controller as defined in claim 19 wherein the opening defined by the mounting plate is generally rectangular, and the gauge plate is gimbal mounted with its first and second straight edges respectively generally aligned with adjacent edges of the rectangular opening defined by the mounting plate.

21. A joystick controller for converting omnidirectional pivoting manual displacement by an operator to electrical control signals, the joystick controller comprising:

A) a mounting plate defining an opening therethrough;

B) a gimbal mounting means having 1) an outer ring secured to the mounting plate surrounding the opening defined therethrough; and 2) an inner member pivotally mounted to the outer ring, the inner member defining an opening therethrough;

C) a joystick shaft pivotally mounted intermediate its length to the inner member and extending through the opening in the inner member and the opening in the mounting plate, wherein the joystick shaft is gimbal mounted with respect to the mounting plate;

D) a knob on one end of the joystick shaft and a centering collar slidably received on the joystick shaft between the knob and the outer ring of the gimbal mount, and a spring biasing the centering collar against the outer ring, the centering collar having an annular surface which seats on the outer ring to center the joystick in a neutral position;

E) a gauge plate on the other end of the joystick shaft, the gauge plate having a first straight edge and a second straight edge perpendicular thereto;

F) a subplate mounted spaced from the mounting plate with the gauge plate and displacement thereof accommodated therebetween; and G) first and second transducers and first and second respectively associated lever arms pivotally mounted on the subplate for operating the transducers, the first lever arm biased against the first edge of the gauge plate for operating the first transducer in response to movement of the gauge plate in a first axis, and the second lever arm biased against the second edge of the gauge plate for operating the second transducer in response to movement of the gauge plate in a second axis;

wherein displacement of the knob end of the joystick shaft causes corresponding displacement of the gauge plate, thereby operating the lever arms and associated transducers for producing control signals indicative of the displacement.

22. A joystick controller as defined in claim 21 wherein the first and second transducers are potentiometers mounted on the subplate, and the first and second lever arms are respectively mounted to rotate input shafts of the first and second transducers.

23. A joystick controller as defined in claim 22 wherein the lever arms include follower rods engaged against the first and second straight edges of the gauge plate.

24. A joystick controller as defined in claim 21 wherein the first and second transducers are Hall effect devices mounted to the subplate and actuated by magnets mounted to the first and second lever arms, wherein pivoting of the lever arms moves the magnets relative to the Hall effect sensing devices.

25. A joystick controller as defined in claim 24 wherein the lever arms include follower rods engaged against the first and second straight edges of the gauge plate.

26. A joystick controller as defined in claim 21 wherein the first and second transducers are LVDT transducers each including a core slug slidably disposed in a multiple coil array and displaced therein by its respective lever arm actuator.

27. A joystick controller as defined in claim 21 wherein the first and second transducers are LED-based transducers including a light source and a light detector mounted to the subplate, and a vane mounted to the associated lever arm actuator controlling the transmission of light therebetween.

28. A joystick controller as defined in claim 21 wherein the first and second lever arms each have a follower rod extending therefrom, and the follower rods are respectively biased against the first and second straight edges of the gauge plate.

29. A joystick controller as defined in claim 28 wherein the lever arms are biased against the gauge plate by coil springs, each follower rod having one end of a coil spring secured thereto with the other end of the coil spring secured to the gauge plate.

* * * * *